US009448023B2

(12) United States Patent
Sheets, Jr. et al.

(10) Patent No.: US 9,448,023 B2
(45) Date of Patent: Sep. 20, 2016

(54) FIREARM SAFETY ASSEMBLY INCLUDING A LEVER DETENT SPRING

(71) Applicant: Sig Sauer, Inc., Newington, NH (US)

(72) Inventors: Robert E. Sheets, Jr., Portland, OR (US); Ethan Lessard, East Kingston, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 14/333,246

(22) Filed: Jul. 16, 2014

(65) Prior Publication Data

US 2015/0027020 A1 Jan. 29, 2015

Related U.S. Application Data

(60) Provisional application No. 61/858,803, filed on Jul. 26, 2013.

(51) Int. Cl.
*F41A 17/00* (2006.01)

(52) U.S. Cl.
CPC ..... *F41A 17/00* (2013.01)

(58) Field of Classification Search
CPC ..... F41A 17/00; F41A 17/46; F41A 17/56; F41A 17/64; F41A 17/74
USPC ..... 42/69.01–69.03, 70.01, 70.05, 70.06, 42/70.11; 89/142, 148, 150, 27.12
See application file for complete search history.

(56) References Cited

U.S. PATENT DOCUMENTS 2,225,583 A * 12/1940 Blizard ..... F41A 17/46 42/70.06
2,383,487 A * 8/1945 Johnson, Jr. ..... F41A 19/02 89/141
2,387,669 A * 10/1945 Loomis ..... F41A 17/46 42/70.06
2,453,683 A * 11/1948 Caldow ..... A41F 17/46 42/70.04
3,624,947 A * 12/1971 Worrall ..... A41F 17/74 42/66
3,857,322 A * 12/1974 Lichtman ..... F41A 3/82 42/15
4,176,584 A * 12/1979 Thomas, Jr. ..... F41A 17/38 89/138
4,208,947 A * 6/1980 Hillberg ..... F41A 17/74 42/70.08
4,414,769 A * 11/1983 Mueschke ..... F41A 35/06 42/70.01
4,654,993 A * 4/1987 Atchisson ..... F41A 3/72 42/71.01
4,681,020 A * 7/1987 Polanecky ..... F41A 9/62 42/70.02
4,693,170 A * 9/1987 Atchisson ..... F41A 3/72 89/149
5,903,994 A * 5/1999 Tange ..... F41A 11/00 42/70.01
6,141,896 A * 11/2000 Oberst ..... F41A 17/02 42/70.06
6,173,518 B1 * 1/2001 Oberst ..... F41A 17/02 42/70.06
6,256,917 B1 * 7/2001 Findlay ..... F41A 17/02 42/70.06
8,756,847 B2 * 6/2014 Huther ..... F41A 17/74 42/70.01
2013/0111796 A1 * 5/2013 Dionne ..... F41A 17/00 42/70.11

* cited by examiner

*Primary Examiner* — Jonathan C Weber
(74) *Attorney, Agent, or Firm* — Finch & Maloney PLLC

(57) ABSTRACT

A two-position firearm safety assembly is disclosed. The assembly includes a lever detent spring and a first lever, both of which are pivotally coupled to a firearm frame. The assembly can also include a second lever and a link connecting the two levers. The detent spring is in contact with the link and/or the first lever at an assembly pivot point, putting the detent spring in compression. The compression force on the detent spring provides two distinct safety assembly positions (e.g., fire and safe positions), and prevents the safety assembly from perching between the two-positions. The properties of the detent spring (e.g., the material, shape, hardness, spring constant, pre-compression in the safety assembly, etc.) can be customized as desired to adjust the properties of the safety assembly, such as the forces needed to toggle the assembly.

20 Claims, 8 Drawing Sheets

FIREARM SAFETY ASSEMBLY INCLUDING A LEVER DETENT SPRING

CROSS-REFERENCE TO RELATED APPLICATIONS

This application claims the benefit of U.S. Provisional Patent Application No. 61/858,803, filed on Jul. 26, 2013, which is herein incorporated by reference in its entirety.

FIELD OF THE DISCLOSURE

The disclosure relates to firearms and more particularly to a firearm safety assembly.

BACKGROUND

Firearm design involves a number of non-trivial challenges, including the design of firearm safety mechanisms. Safety mechanisms are used to help prevent the accidental firing or discharge of a firearm, which can help ensure safer handling.

SUMMARY

One example embodiment of the present invention provides a firearm safety assembly comprising: a first lever pivotally coupled to a frame at a first frame pivot point; and a detent spring pivotally coupled to the frame at a second frame pivot point and in contact with the first lever at an assembly pivot point; wherein the detent spring is under compression, the compression force in a direction substantially aligned with a major plane of the frame; and wherein the detent spring is configured to pivot relative to the first lever at the assembly pivot point. In some cases the compression force on the detent spring biases the assembly pivot point away from a straight line alignment with the first frame pivot point and the second frame pivot point. In some cases, the first lever includes a protrusion configured to mechanically block and/or disengage a firing component of the firearm. In some cases, the assembly further comprises: a second lever pivotally coupled to the frame at a third frame pivot point; and a link connecting the first and second levers. In some such cases, a main axis of the link aligns with the axis of rotation at the assembly pivot point. In some cases, the detent spring includes an aperture configured to align with a boss on the frame. In some cases, the detent spring is inserted into a recess in the frame and thereby does not increase the maximum width of the frame. In some cases, the detent spring is symmetrical along at least one axis of the detent spring. In some cases, the detent spring is asymmetrical along all axes of the detent spring. In some cases, the detent spring is stamped from a single sheet of metal.

Another example embodiment of the present invention provides a two-position lever detent assembly comprising: a first lever pivotally coupled to a firearm frame at a first frame pivot point; and a detent spring pivotally coupled to the frame at a second frame pivot point and in contact with the first lever at an assembly pivot point; wherein in a first assembly position, the force vector at the assembly pivot point is in a first direction; and wherein in a second assembly position, the force vector at the assembly pivot point is in a second direction substantially opposite the first direction. In some cases, the first assembly position is a firearm fire position and the second assembly position is a firearm safe position. In some cases, substantially opposite is within 20 degrees from exactly opposite. In some cases, the magnitude of the force vector at the assembly pivot point in the first assembly position is greater than the magnitude of the force vector at the assembly pivot point in the second assembly position. In some cases, in a third assembly position, the assembly pivot point includes two force vectors that are substantially opposite in direction. In some such cases, the magnitudes of the force vectors at the third assembly position are equal, while in some other cases, the magnitudes of the force vectors at the third assembly position are not equal. In some cases, positive feedback is provided by the assembly when switching between the first and second assembly positions.

Yet another example embodiment of the present invention provides a firearm safety assembly comprising: a first lever pivotally coupled to a frame at a first frame pivot point; a second lever pivotally coupled to the frame at a second frame pivot point; a link connecting the first and second levers; and a detent spring pivotally coupled to the frame at a third frame pivot point and in contact with the link. In some cases, the detent spring is under compression, the compression force in a direction substantially aligned with a major plane of the frame.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the inventive subject matter.

Figure 1A:
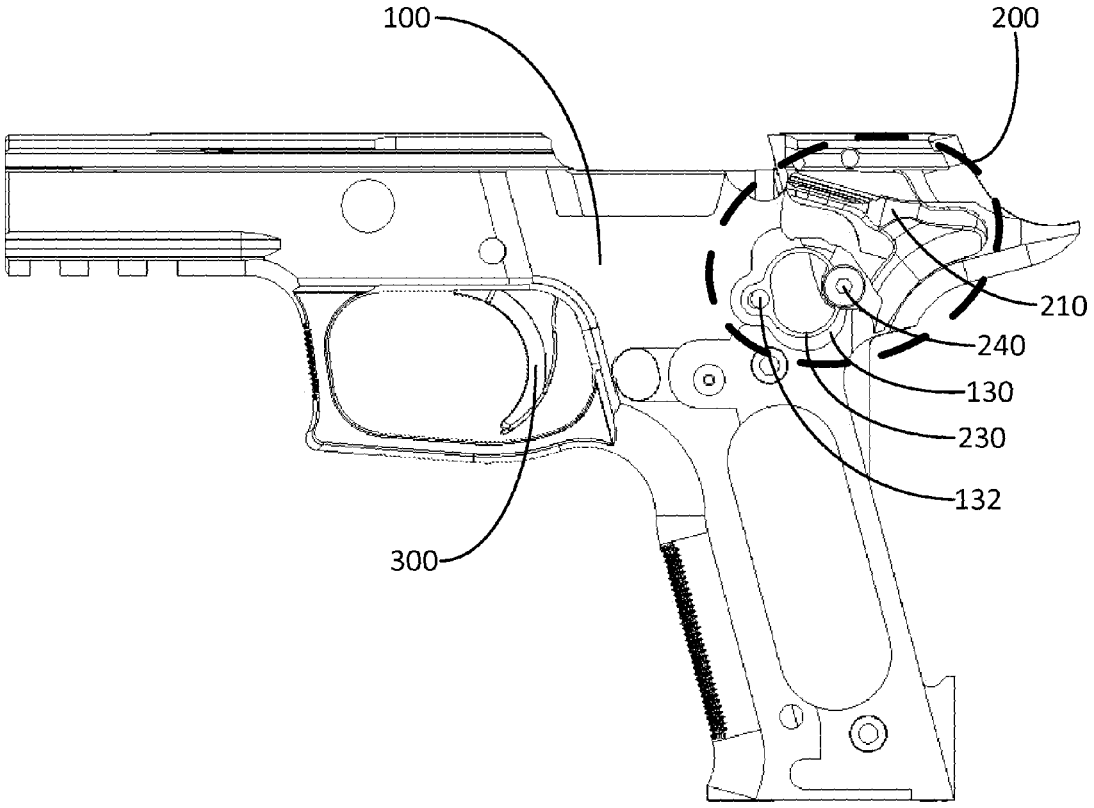
FIG. 1A is a left planar view of a firearm frame including a safety assembly configured in accordance with an embodiment of the present disclosure.

These and other features of the present embodiments will be understood better by reading the following detailed description, taken together with the figures herein described. In the drawings, each identical or nearly identical component that is illustrated in various figures may be represented by a like numeral. For purposes of clarity, not every component may be labeled in every drawing. Furthermore, as will be appreciated, the figures are not necessarily drawn to scale or intended to limit the claimed invention to the specific configurations shown. In short, the figures are provided merely to show example structures.

DETAILED DESCRIPTION

A firearm safety assembly including a lever detent spring is disclosed. The disclosed assembly may include a first and second lever pivotally coupled to a firearm frame, a linking bolt connecting the two levers, and a detent spring pivotally coupled to the frame. In some instances, the safety assembly may include only the first lever and the detent spring. When the assembly is installed on a firearm frame, the detent spring is in contact with the linking bolt and/or the first lever, putting the detent spring in compression. The compression force provides two distinct positions, such as a fire position and a safe position, and may hinder the safety assembly from perching between the positions. Further, the disclosed safety assembly may provide positive feedback when toggling between the fire and safe positions. The functioning detent spring may be one part and the properties of the detent spring (e.g., the material, shape, hardness, spring constant, etc.) may be customized as desired to adjust the properties of the safety assembly (e.g., the force needed to toggle to/from the fire and safe positions). The detent spring may be configured to fit within a recess in a firearm frame, such that it does not add any width to a fully assembled firearm. Further, the detent spring (and therefore, the overall disclosed firearm safety assembly) is reliable, inexpensive, easy to manufacture, and easy to install. Numerous configurations and variations will be apparent in light of this disclosure.

General Overview

There are a number of non-trivial issues related to the design of a firearm safety mechanism. For example, such issues may relate to the functionality of the safety mechanism, the number of parts included, the feedback provided, the method of manufacture, and the method of installation. As a general matter, it may be advantageous to have a safety mechanism design that provides two distinct positions (e.g., safe and fire positions), has a low number of parts, provides positive feedback when switching between the safe and fire positions, is easy to manufacture, and is easy to install.

Thus, and in accordance with a set of embodiments of the present disclosure, a firearm safety assembly including a lever detent spring is disclosed. In some embodiments, the disclosed safety assembly may include a first lever pivotally coupled to a firearm frame at a first frame pivot point and a second lever pivotally coupled to the frame at a second pivot point. The safety assembly may also include a link (e.g., a linking bolt) connecting the first and second levers. Further, the safety assembly in such embodiments may also include a detent spring pivotally coupled to the frame and in contact with the link and/or the first lever to allow the detent spring and first lever to pivot relative to each other. The contact between the detent spring and the first lever may be direct or indirect (e.g., where the detent spring is making contact with a link connected to or in contact with the first lever). In some embodiments, the safety assembly may only include the first lever and detent spring to reduce the number of parts or components in the assembly, for example.

In some embodiments, the detent spring may be under compression (or in tension) in the safety assembly, thereby providing the assembly with two distinct positions—a first position (e.g., a fire position) and a second position (e.g., a safe position). In such embodiments, the detent spring has a maximum compression force when the assembly pivot point is in line with the first lever and detent spring pivot points (relative to the frame), referred to herein as a mid-stroke position. In this manner, the assembly is difficult to maintain in the mid-stroke position, thereby providing the benefit of having a mechanism that avoids perching between the two distinct positions. This may be particularly beneficial for the safety assembly, since perching in between fire and safe positions is highly undesirable. In some embodiments, a portion of one or more of the components of the safety assembly may mechanically block and/or disengage a firearm firing component (e.g., a trigger bar) when in a safe position. Although the two-position lever detent assembly is primarily disclosed in the context of a safety assembly for a firearm, the assembly as variously described herein may be used in other contexts. For example, the assembly may be used for a firearm fire selector. More generally, the assembly may be used as a toggle switch or two-position lever detent mechanism for any application or context.

As will be appreciated in light of this disclosure, some embodiments may realize benefits or advantages as compared to existing approaches. For instance, in some embodiments, the safety assembly may have a small number of parts or components (e.g., two to four components), and the components may be simple parts that are easy to manufacture or construct (e.g., stamping the detent spring from a single metal sheet). Further, installation of the safety assembly components on a firearm frame may be simple and intuitive. In some embodiments, the detent spring is a single part and in some instances, properties of the detent spring (e.g., the material, shape, hardness, spring constant, pre-compression of the spring in the assembly, etc.) may be customized as desired to adjust the properties of the safety assembly as a whole, such as the force needed to switch from fire to safe position, or from safe to fire position. In some embodiments, the safety assembly may provide positive feedback when toggling between the fire and safe positions, which may be pleasing to some users. Such feedback may be increased by increasing the pre-compression of the detent spring in the assembly or decreased by decreasing the pre-compression of the detent spring in the assembly.

In some embodiments, the detent spring of the safety assembly may be constructed to fit partially or completely within a recess in a firearm frame. In such embodiments, the detent spring, which may be the only functioning part of the safety assembly, may add minimal or no width to the firearm frame. Also, some embodiments may utilize small form factor components constructed from materials which are lightweight, resilient, inexpensive, etc. In some such instances, minimal (or otherwise negligible) mass and/or bulk may be added to the host firearm, thereby helping to maintain a reliable, lightweight, compact firearm. Also, in some instances, a reduction in cost (e.g., of production, of repair, of replacement, etc.) may be realized. In some cases, and in accordance with an embodiment, a safety assembly provided using the disclosed techniques can be configured, for example, as: (1) a partially/completely assembled safety assembly unit; and/or (2) a kit or other collection of discrete components (e.g., a first lever, a second lever, a link such as a linking bolt, and a detent spring as variously described herein) which may be operatively coupled as desired. Numerous configurations and variations will be apparent in light of this disclosure.

Structure and Operation

Figure 1B:
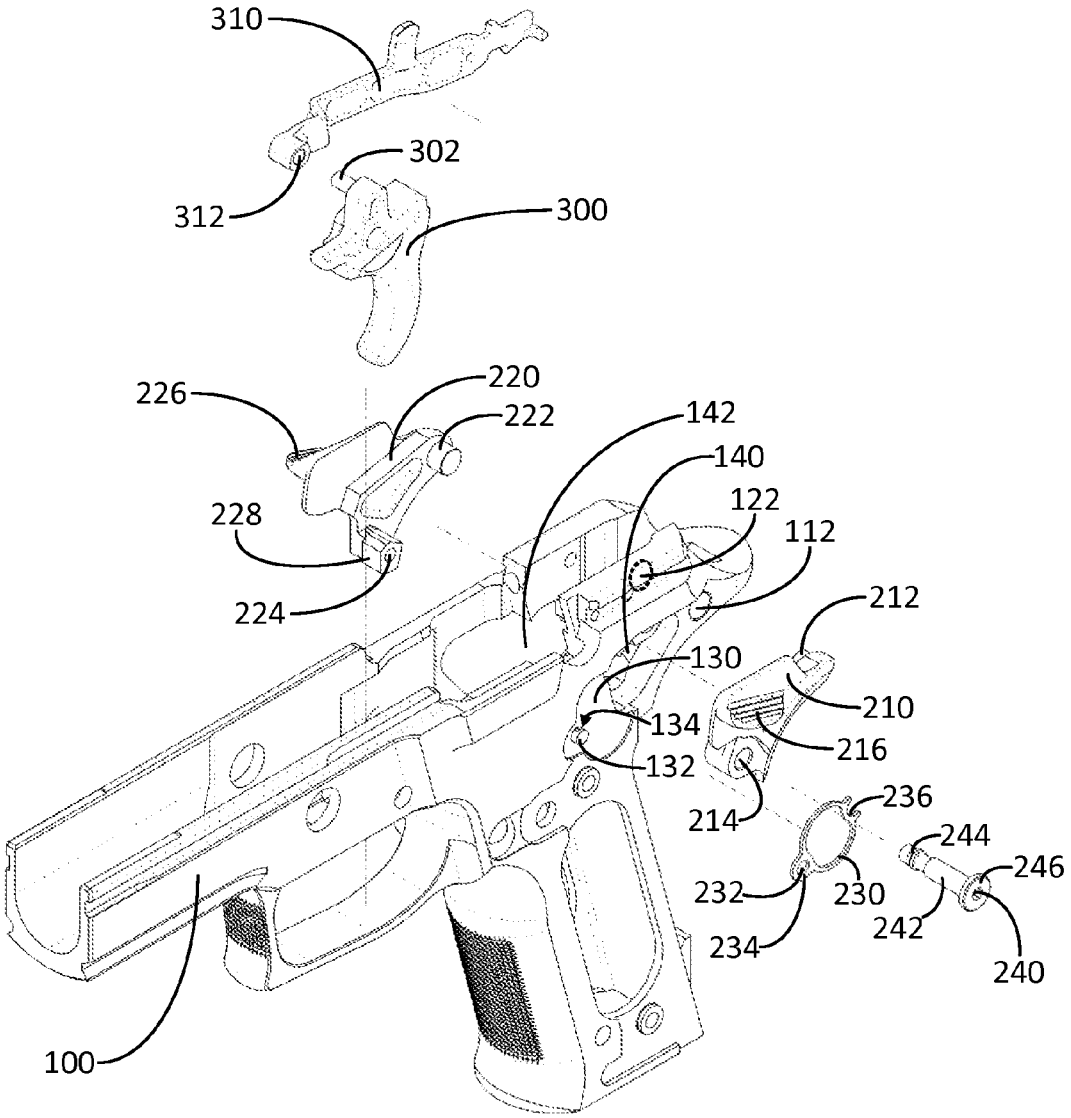
FIG. 1B is an exploded view of a firearm frame including a safety assembly configured in accordance with an embodiment of the present disclosure.

FIGS. 1A and 1B are a left planar view and an exploded view, respectively, of a firearm frame 100 including a safety assembly 200 configured in accordance with an embodiment of the present disclosure. As shown, frame 100 is the frame of a pistol, such as the P220® pistol produced by Sig Sauer, Inc. However, the present disclosure is not so limited. For instance, in some embodiments, safety assembly 200 as variously described herein may be installed or used on any suitable firearm, including various pistols or handguns, or various rifles, machine guns, shotguns, etc. Safety assembly 200 as variously described herein may also be installed on replica firearms, such as airsoft guns, for example. The assembly 200 in this embodiment includes a first lever 210, a second lever 220, a detent spring 230, and a linking bolt 240 connecting the first lever 210 and the second lever 220. Each of these components is discussed in detail below. In other embodiments, assembly 200 may only include a first lever 210 and a detent spring 230, as will be apparent in light of this disclosure. Although assembly 200 is primarily described herein in the context of a safety assembly for a firearm for ease of description, assembly 200 as variously disclosed herein may be used in other contexts, such as for a firearm fire selector or, more generally, as a toggle switch or two-position lever detent mechanism, for example. Therefore, the claimed invention is not intended to be limited to a safety assembly for a firearm, unless otherwise stated.

As can be seen in FIG. 1B, in this embodiment, safety assembly 200 is configured to secure to or install on frame 100 such that first lever 210, second lever 220, and detent spring 230 are all pivotally coupled to frame 100. The safety assembly 200 in this embodiment is a thumb safety located near the rear of frame 100. In other words, a user holding a fully assembled pistol including frame 100 with safety assembly 200 installed can use a thumb to interact with lever 210 and/or 220 as will be apparent in light of this disclosure. For example, a user can toggle safety assembly 200 between a first position (e.g., a fire position) and a second position (e.g., a safe position) by pressing on first lever pad 216 and/or second lever pad 226. In the specific embodiment shown in FIG. 1A, the user can lower lever 210 and/or 220 to toggle to the first/fire position and raise lever 210 and/or 220 to toggle to the second/safe position. In some instances, first lever pad 216 (located on the left side of frame 100 in this embodiment) may be more convenient for a user holding a firearm including safety assembly 200 with the right hand, whereas second lever pad 226 (located on the right side of frame 100 in this embodiment) may be more convenient for a user holding the firearm with the left hand.

Figure 2A:
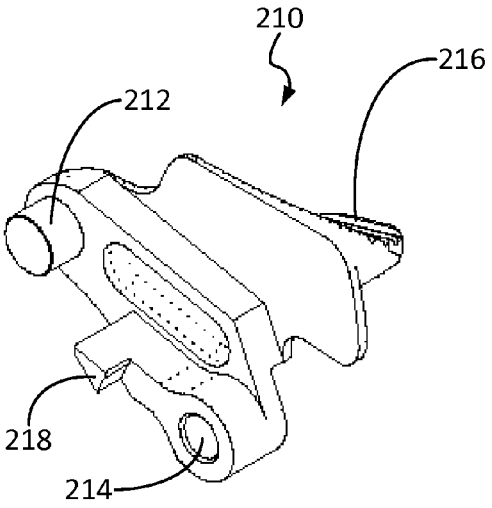
FIG. 2A illustrates a first lever for a safety assembly configured in accordance with an embodiment of the present disclosure.
Figure 2B:
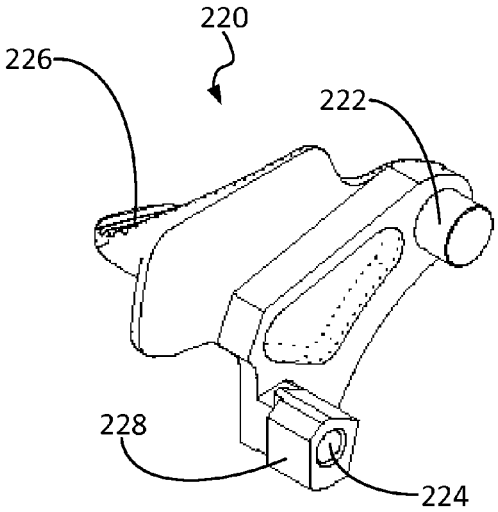
FIG. 2B illustrates a second lever for a safety assembly configured in accordance with an embodiment of the present disclosure.

First lever 210, shown in FIG. 2A, includes post 212 and second lever 220, shown in FIG. 2B, includes post 222. Posts 212 and 222 are each configured to insert into frame bores 112 and 122, respectively, to pivotally couple levers 210 and 220 to frame 100 (e.g., when the levers are linked using linking bolt 240 as discussed below). In addition, levers 210 and 220 include blocking portions 218 and 228, respectively, which may be used to block or disengage a firearm firing component when safety assembly 200 is in a safe position, as will be discussed with reference to FIGS. 7A-B. As will be apparent in light of this disclosure, first and second levers 210, 220 may be customized to various shapes or sizes, and the examples shown in FIGS. 2A-B, respectively, are provided for illustrative purposes only. In addition, first and second levers 210, 220 can be constructed from any suitable material, such as various metals (e.g., steel) or plastics (e.g., polypropylene) based on the particular application of assembly 200. In an example embodiment, first and second levers 210, 220 are constructed from MIM 4605 low alloy steel.

Figure 2C:
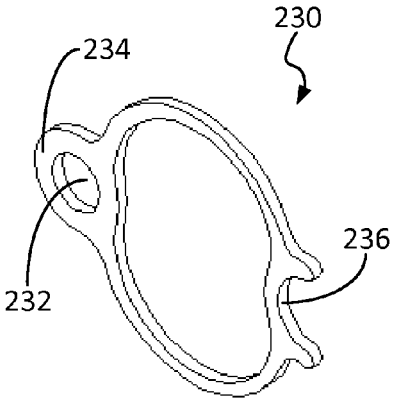
FIG. 2C illustrates a detent spring for a safety assembly configured in accordance with an embodiment of the present disclosure.
Figure 2D:
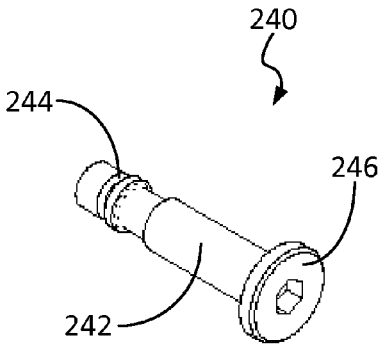
FIG. 2D illustrates a linking bolt for a safety assembly configured in accordance with an embodiment of the present disclosure.

Linking bolt 240, shown in FIG. 2D, may then be used to link levers 210 and 220 together by screwing linking bolt threaded end 244 into lever receiving port 224 after it is passed through lever bore 214. In this manner, levers 210 and 220 may be secured to frame 100. Note that linking bolt 240 as well as portions of the first and second levers 210, 220 may pass into and/or through frame apertures 140 and 142 when safety assembly is installed on frame 100 in this embodiment. Also note that main shaft portion 242 of linking bolt 240 may be used to block or disengage a firearm firing component when safety assembly 200 is in a safe position, as will be discussed with reference to FIGS. 7A-B. As will be apparent in light of this disclosure, linking bolt 240 may be customized to various shapes or sizes, and the example provided in FIG. 2D is provided for illustrative purposes only. In addition, linking bolt 240 can be constructed from any suitable material, such as various metals (e.g., steel) or plastics (e.g., polypropylene) based on the particular application of assembly 200. In an example embodiment, linking bolt 240 is constructed from 17-4 stainless steel. Further, in some embodiments, first lever 210 and second lever 220 may be connected or linked in another suitable manner. For example, linking bolt 240 may be configured to snap into lever receiving port 224, levers 210 and 220 may be linked by some other component, or levers 210 and 220 may be one contiguous piece that wraps around the rear of frame 100.

Detent spring 230, shown in FIG. 2C, includes aperture 232 surrounded by mounting portion 234, which is configured to be mounted onto frame boss 132, such that frame boss 132 inserts into detent spring aperture 232 and detent spring 230 is positioned inside frame recess 130 (as shown in FIG. 1A). In some embodiments, frame recess 130 and/or detent spring 230 may be formed to allow the outer plane of detent spring 230 to be flush with or deeper than the frame area surrounding frame recess 130. In other words, since detent spring 230 can have a very narrow construction, it may be formed to fit completely inside of frame recess 130 so as to not add to the maximum width of frame 100, which may be beneficial when trying to reduce the size (or at least not add to the size) of a fully assembled firearm. As can be seen in FIG. 1B, frame boss 132 includes slot 134, which may help secure mounting portion 234 onto frame boss 132 when detent spring 230 is installed on frame 100. In some instances, frame boss 132 may include a ridge or protrusion (not shown) to help secure mounting portion 234 of detent spring 230 onto frame boss 132. Such a ridge or protrusion could be located, for example, on the cylindrical body of frame boss 132 allowing detent spring aperture 232 to be pressed over the ridge or protrusion and snap onto frame boss 132. In other embodiments, detent spring 230 may be secured to frame 100 in another suitable manner. For example, in one embodiment, detent spring 230 may include a boss configured to be secured to an aperture in frame 100. In another example embodiment, detent spring 230 may be secured to frame 100 using an additional component, such as a screw, bolt, pin, etc.

Detent spring 230 also includes yoke 236, which is configured to contact main shaft 242 of linking bolt 240 when installed in the safety assembly 200 of this embodiment, such as is shown in FIG. 1A. As can be seen in this embodiment, when installed, yoke 236 of detent spring 230 is located between linking bolt head 246 and first lever 210. Yoke 236 may be any shape that allows detent spring 230 to remain in contact with linking bolt 240 (or first lever 210), such as an open or curved portion, or a c-shaped portion (e.g., as shown in FIG. 2C). In some embodiments, yoke 236 may be closed to create a port that may be placed on a post on first lever 210 or that linking bolt 240 may pass through when installing the safety assembly, for example. In this specific embodiment, yoke 236 has a radius approximately equal to the radius of shaft 242. Therefore, detent spring 230 may be installed before or after linking bolt 240 is used to link levers 210 and 220 through frame 100. Regardless, when installed, detent spring 230 is put into a compressed state having compression force Fc as will be discussed in more detail below with reference to FIGS. 4A-C. As will be apparent in light of this disclosure, detent spring 230 may be customized to various shapes or sizes, and the example provided in FIG. 2C is provided for illustrative purposes only. Further, the construction of detent spring 230 may affect its characteristics (e.g., spring constant) and thus the characteristics of assembly 200, since detent spring 230 is the only functioning part of assembly 200. For example, detent spring 230 can be constructed from any suitable material, such as various metals (e.g., steel) or plastics (e.g., polypropylene) based on the particular application of assembly 200. In one example embodiment, detent spring 230 is constructed from 1095 spring steel. In such an embodiment, detent spring 230 may be stamped from a single sheet of metal.

As will be discussed with reference to FIGS. 7A-B, safety assembly 200 in this embodiment can be used as a mechanical block or disengagement mechanism for one or more firearm firing components (when in a second/safe position). For example, safety assembly 200 may be used as a mechanical block for trigger bar 310 shown in FIG. 1B. Trigger 300 in this embodiment includes a trigger post 302 configured to insert into trigger bar port 312 to allow the two components 300, 310 to interact with each other. For example, when trigger 300 and trigger bar 310 are installed in frame 100, trigger 300 may be pulled toward the rear of frame 100 by a user (e.g., using one or more fingers) to cause trigger bar 310 to move forward in frame 100. Such an action may cause further interaction with additional firing components in a fully assembled firearm, such as triggering a sear (not shown), for example, which may cause the firearm to fire when loaded with ammunition. The interaction between safety assembly 200 and trigger bar 310 will be discussed below in more detail with reference to FIGS. 7A-B.

In some embodiments, assembly 200 may only include first lever 210 and detent spring 230. In such embodiments, first lever 210 and detent spring 230 may be pivotally coupled to frame 100, with detent spring 230 in contact with first lever 210. For example, with reference to first lever 210, post 212 shown in FIG. 2A may be configured to snap into aperture 112 on frame 100. In another example, post 212 may be configured to screw into aperture 112, where aperture 112 is threaded. In another example, post 212 may be configured with a hole in an end to allow a pin to secure it to the frame. Alternatively, frame 100 may have a post configured to connect to an aperture or recess in first lever 210 in manner to pivotally couple the first lever 210 to the frame 100. Any suitable features of first lever 210 and/or frame 100, as well as any additional suitable components, may be used to pivotally couple the first lever 210 to the frame 100. Further, in embodiments only including one lever (e.g., first lever 210) and a detent spring, the lever and/or detent spring may include additional features to allow the two components to come in contact and remain secured to frame 100 when installed. For example, in one embodiment, first lever 210 may include a post section with an end cap (e.g., located where linking bolt 240 would have been) that yoke 236 of detent spring 230 can contact when assembly 200 (including only a single lever and detent spring) is installed on frame 100. In such an example, this would be as though the portion of linking bolt 240 as shown in FIG. 1A was instead a feature of first lever 210. However, the present disclosure is not so limited.

In embodiments of assembly 200 that include only a single lever (and a detent spring), the assembly may be installed on frame 100 based on the hand intended to be used for the firearm. For example, if assembly 200 is being used as a thumb safety assembly (e.g., as shown in FIG. 1A and described herein), then safety assembly 200 may be installed on the left side of frame 100 for a right-handed firearm and it may be installed on the right side of frame 100 for a left-handed firearm. In instances where safety assembly 200 is intended to be installed on the right side of frame 100 (e.g., for a left-handed firearm), frame features 132 and 130 may be located on the right side of frame 100 to allow for installation of safety assembly 200. In instances where assembly 200 is being used as a fire selector (e.g., to switch between semi and fully automatic modes) or for another application, then the location that assembly 200 is installed may be based on the particular firearm and/or the application of assembly 200. Note that using a lever on either side of frame 100 for assembly 200 (e.g., as shown in FIGS. 1A-B) provides an ambidextrous configuration.

Figure 3:
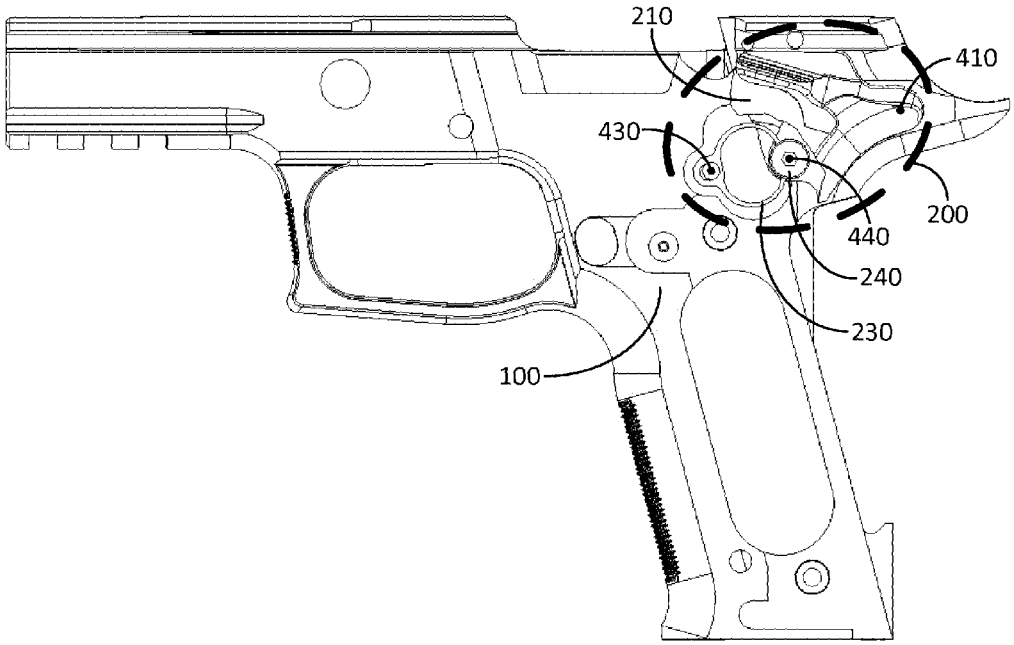
FIG. 3 illustrates pivot points of a safety assembly configured in accordance with an embodiment of the present disclosure.

FIG. 3 illustrates pivot points 410, 430, and 440 of safety assembly 200 configured in accordance with an embodiment of the present disclosure. In this embodiment, first lever 210 is pivotally coupled to frame 100 at frame pivot point 410, second lever 220 is pivotally coupled to frame 100 at frame pivot point 420 (shown in FIGS. 7A-B), and detent spring 230 is pivotally coupled to frame 100 at frame pivot point 430. Therefore, in this embodiment, the three components—first lever 210, second lever 220, and detent spring 230—pivot about axes extending perpendicularly (relative to the sides of frame 100 shown in FIG. 3 and FIGS. 7A-B) through frame pivot points 410, 420, and 430, respectively. Assembly pivot point 440 is also shown, which is the point of rotation or pivoting for safety assembly 200. In other words, it is the pivot point of the detent spring 230 relative to the first lever and/or linking bolt 240. Note that assembly pivot point 440 moves as safety assembly 200 is moved/toggled. In the embodiment shown in FIG. 3, assembly 200 pivots about an axis extending perpendicularly (relative to the side of frame 100 shown in FIG. 3) through pivot point 440. In this embodiment, assembly 200 pivots about the main axis of linking bolt 240. Note that pivot points 410 (first lever frame pivot point), 420 (second lever frame pivot point), 430 (detent spring pivot point), and 440 (assembly pivot point) are depicted as black dots in FIGS. 3, 4A-C, and 7A-B for illustrative purposes.

Figure 4A:
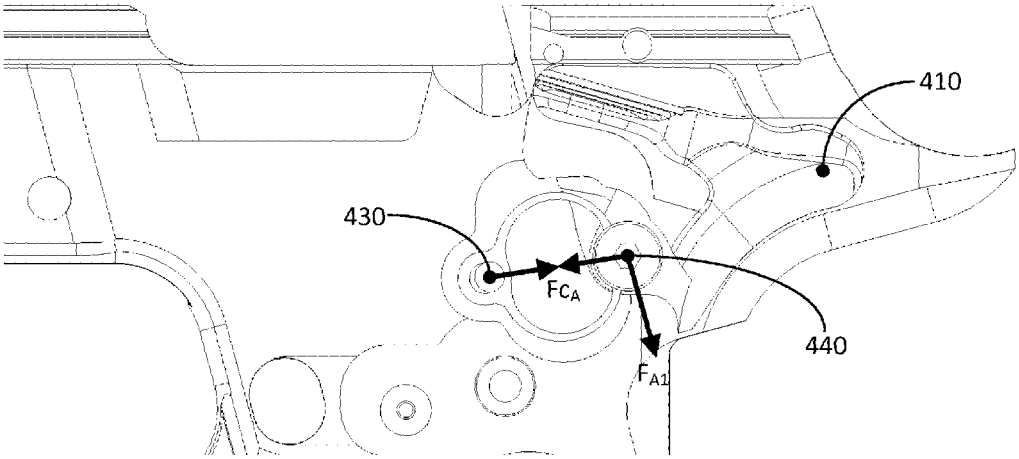
FIGS. 4A-C illustrate a safety assembly in first, mid-stroke, and second positions, respectively, in accordance with an embodiment of the present disclosure.
Figure 4B:
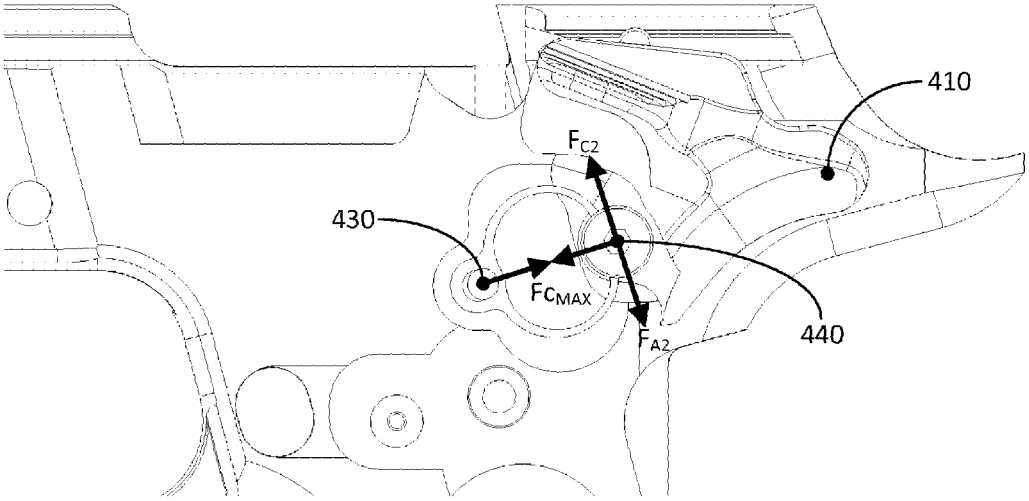
Figure 4C:
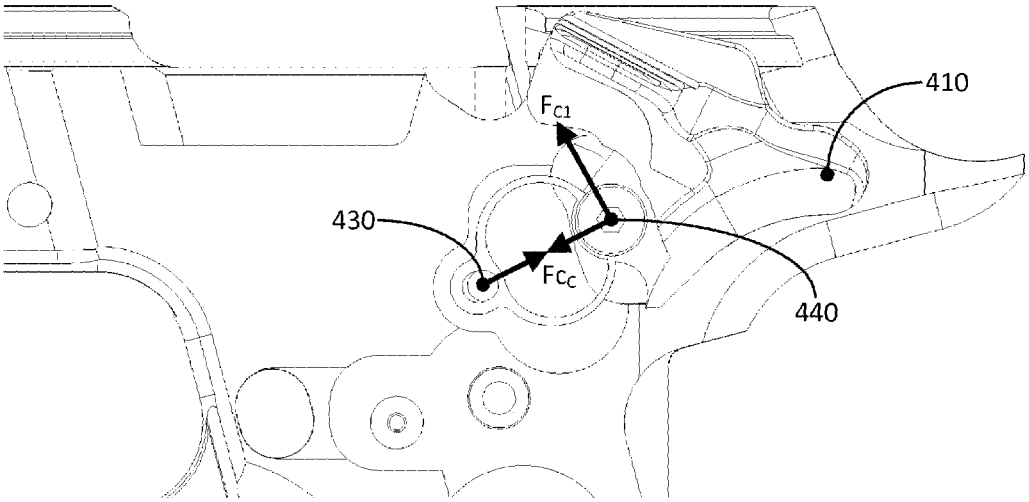

FIGS. 4A-C illustrate safety assembly 200 in first, mid-stroke, and second positions, respectively, in accordance with an embodiment of the present disclosure. FIGS. 5A-D illustrate detent spring 230 in first, mid-stroke, second, and uninstalled positions, respectively, in accordance with an embodiment of the present disclosure. As can be seen in FIG. 4A, assembly 200 is in a first or downward position in this embodiment, which may have been the result of pushing down on first lever pad 216 (e.g., using a thumb). Note that in this embodiment, second lever 220 is on the direct opposite side of frame 100 and moves in tandem with first lever 210 since the two levers 210 and 220 are connected by linking bolt 240. However, as previously explained in some embodiments, assembly 200 may only include one lever along with the detent spring. As previously described, when installed on frame 100, detent spring 230 of safety assembly 200 is pre-compressed, having a compression force Fc (more specifically $Fc_A$ in the case of FIG. 4A). In other embodiments, the detent spring may be under tension and have a tensile force acting on it. Continuing with the present embodiment, the compression force Fc is in a direction substantially aligned with a major plane of frame 100. More specifically, Fc is in a direction substantially aligned with the plane of frame 100 shown in FIGS. 3 and 4A (i.e., the left side of frame 100). The pre-compression on detent spring 230 which causes compression forces Fc at various assembly positions may be adjusted in various ways, as will be described below.

Figure 5A:
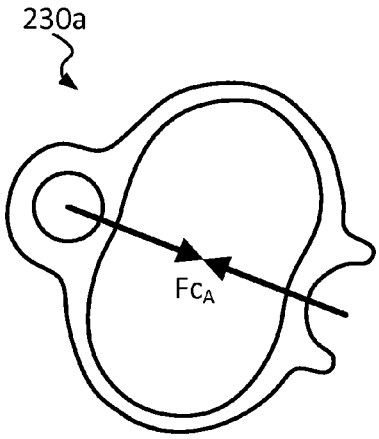
FIGS. 5A-D illustrate a detent spring in first, mid-stroke, second, and uninstalled positions, respectively, in accordance with an embodiment of the present disclosure.

As shown in FIG. 4A, compression force $Fc_A$ causes force vector $F_{A1}$ at assembly pivot point 440, which maintains assembly 200 in the first position until sufficient force is applied to move first lever 210 upward past the mid-stroke assembly location shown in FIG. 4B to, for example, the second position shown in FIG. 4C. FIG. 5A illustrates detent spring 230*a* in the first position (as shown in FIG. 4A), having compression force $Fc_A$ acting upon it. In this embodiment, safety assembly 200 does not move farther than the position shown in FIG. 4A due to physical stops between frame 100 (or another firearm component) and a portion of first lever 210, second lever 220, detent spring 230, and/or linking bolt 240 (even though force vector $F_{A1}$ would otherwise cause assembly 200 to move farther). Note that the physical stop for assembly 200 in the first position may be adjusted based on the configuration of assembly 200 and/or frame 100 and the location of the physical stop may have an effect on force vector $F_{A1}$. Also note that the first position of safety assembly 200 as shown in FIG. 4A may be a fire position in a fully assembled firearm, as will be discussed below with reference to FIG. 7A.

Figure 5B:
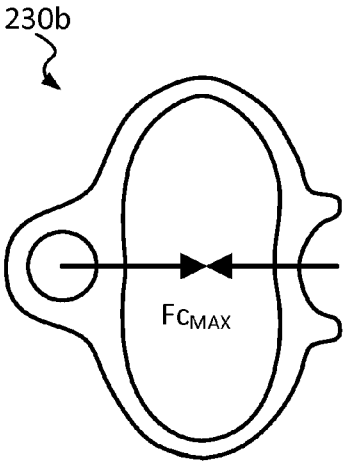

FIG. 4B illustrates safety assembly 200 in a mid-stroke position in accordance with an embodiment of the present disclosure. As shown, the mid-stroke position for assembly 200 occurs when pivot points 410 and 430 form a straight line with assembly pivot point 440. In this embodiment, the compression force Fc in detent spring 230 is at its maximum value ($Fc_{MAX}$). The result of detent spring 230 having a maximum compression force $Fc_{MAX}$ in this mid-stroke position is the creation of two force vectors $F_{A2}$ and $F_{C2}$ at assembly pivot point 440, which have a greater magnitude than force vectors $F_{A1}$ and $F_{C1}$ (discussed below), respectively. Therefore, assembly 200 inherently does not want to be in the mid-stroke position shown in FIG. 4B and will be automatically forced to one side (i.e., either to the first position shown in FIG. 4A or to the second position shown in FIG. 4C). In this manner, assembly 200 is difficult to maintain in the mid-stroke position, thereby providing the benefit of having a mechanism that avoids perching between the two distinct positions. This may be particularly advantageous when using assembly 200 as a safety assembly for a firearm, since a safety mechanism that perches between fire and safe positions is highly undesirable. FIG. 5B illustrates detent spring 230*b* in the mid-stroke position (as shown in FIG. 4B), having compression force $Fc_{MAX}$ acting upon it.

Figure 5C:
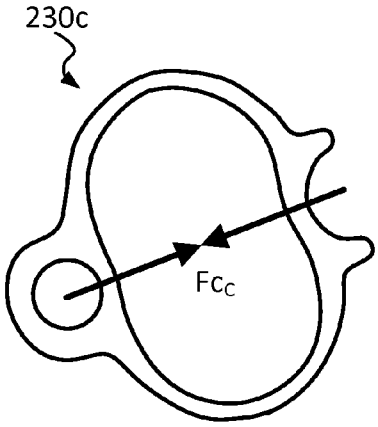
Figure 5D:
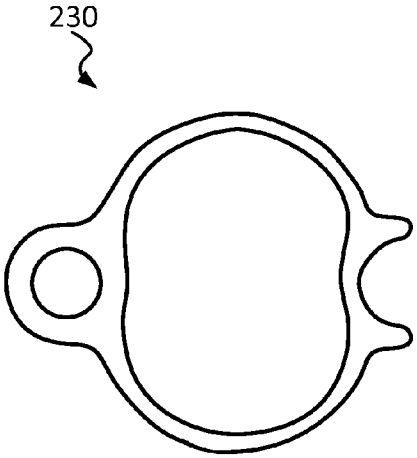
Figure 6A:
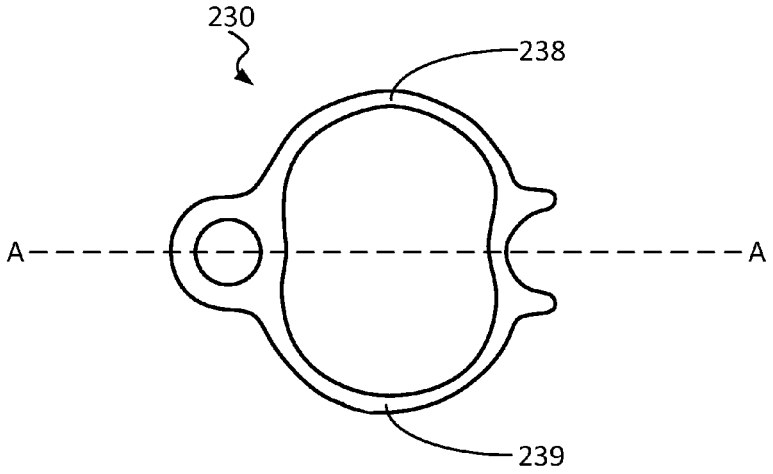
FIGS. 6A-C illustrate example detent springs for a safety assembly configured in accordance with one or more embodiments of the present disclosure.

FIG. 4C illustrates safety assembly 200 in a second position in accordance with an embodiment of the present disclosure. As can be seen, assembly 200 is in a second or upward position in this embodiment, which may have been the result of pushing upward on first lever pad 216 (or second lever pad 226). FIG. 5C illustrates detent spring 230*c* in the second position (as shown in FIG. 4C), having compression force $Fc_C$ acting upon it. Compression force $Fc_C$ causes force vector $F_{C1}$ at assembly pivot point 440, which maintains assembly 200 in the second position until sufficient force is applied to move first lever 210 downward past the mid-stroke assembly location shown in FIG. 4B to, for example, the first position shown in FIG. 4A. In this example embodiment, safety assembly 200 does not move farther than the second position shown in FIG. 4C (even though force vector $F_{C1}$ would normally cause assembly 200 to move farther) due to a physical stop between frame 100 (or another firearm component) and a portion of first lever 210, second lever 220, detent spring 230, and/or linking bolt 240. Note that the physical stop for assembly 200 in the second position may be adjusted based on the configuration of assembly 200 or frame 100 and the location of the physical stop may have an effect on force vector $F_{C1}$. Also note that the second position of safety assembly 200 as shown in FIG. 4C may be a safe position in a fully assembled firearm, as will be discussed below with reference to FIG. 7B. FIG. 5D illustrates detent spring 230 in an uninstalled/uncompressed state (as is also shown in FIGS. 2C and 6A).

In one or more embodiments, the magnitude of the pre-compression as well as the magnitude and/or direction of the force vector F at assembly pivot point 440 (in various positions of assembly 200) may be based on a number of factors. Factors relevant to the pre-compression of detent spring 230 in the embodiment shown in FIGS. 4A-C (e.g., relevant to the compression force Fc) may include, for example, the shape or geometry of the detent spring, the spring constant of the detent spring, the heat treatment of the detent spring when constructed from metal, and/or the position of one or both ends of the detent spring in the assembly. For example, in one case, the pre-compression on detent spring 230 may be increased using the same detent spring 230 by moving location of boss 132 closer to the assembly pivot point 440, whereas pre-compression may be decreased (using the same detent spring 230) by moving location of boss 132 farther from the assembly pivot point 440. In another example case, frame 100 may include multiple bosses to allow the user to select the desired boss for installation and thereby adjust detent spring 230 pre-compression. In such cases, a boss located closer to the assembly pivot point may be used to increase the force needed to toggle assembly 200, whereas a boss located farther from the assembly pivot point may be used to decrease the force needed to toggle assembly 200.

In yet another example case, the pre-compression of detent spring 230 may be decreased by decreasing the diameter of linking bolt 240 (keeping all else the same), or by cutting a groove in the portion of linking bolt main shaft 242 that yoke 236 of detent spring 230 makes contact with, whereas the pre-compression may be increased by increasing the diameter of linking bolt 240 (or at least the portion that yoke 236 makes contact with). Therefore, the pre-compression on detent spring 230 in assembly 200 may be customized as desired. The pre-compression of detent spring 230 may also cause a type of positive (and/or tactile) feedback to be provided when switching/toggling assembly 200 between the first and second positions. The positive feedback may occur when the lever snaps into either the first or second position (e.g., as shown in FIGS. 4A and 4C, respectively) after passing the mid-stroke position (e.g., as shown in FIG. 4B).

As previously described, the magnitude and/or direction of the force vector F at assembly pivot point 440 (in various positions of assembly 200) may be based on a number of factors. Such factors may include the pre-compression force on the detent spring, the shape and construction of the detent spring, the positions of the physical stops for the assembly relative to the frame, and/or the location of the first and second positions relative to the mid-stroke position, for example. In the context of assembly 200 being a thumb safety assembly for a firearm, the amount of force needed to switch between fire and safe positions may be adjusted based on the intended use for the firearm. For example, when using a firearm including safety assembly 200 for military or police applications, assembly 200 may be configured such that a greater amount of force is needed to switch from a safe to a fire position to ensure that the user intended to turn off the safety. In another example, when using a firearm including safety assembly 200 for sport shooting applications, assembly 200 may be configured such that a lower amount of force is needed to switch from a safe to a fire position to allow the user to quickly prepare to fire. In another example, the forces needed to switch to a safe and/or fire position may be configured to withstand or comply with a drop test (e.g., California's firearm drop test).

In the embodiment shown in FIGS. 4A-C, the magnitude of the force vectors $F_{A2}$ and $F_{C2}$ are equal to each other. In other words, in this embodiment, the force needed to switch (or toggle) from the first position to the second position is equal to the force needed to switch from the second position to the first position. Also note that the magnitude of force vectors $F_{A1}$ and $F_{C1}$ are equal to each other, but assembly 200 need not be configured in such a manner. In the context of assembly 200 being used as a firearm thumb safety, in this embodiment, the force needed to switch from fire position to safe position is equal to the force needed to switch from safe position to fire position. A factor contributing to the forces being equal (or nearly equal) is the symmetrical nature (or nearly symmetrical nature) of detent spring 230 used in this embodiment (along dashed line A shown in FIG. 6A). As can be seen in FIG. 6A, sides 238 and 239 (split along dashed line A) of detent spring 230 are equal (or nearly equal) in length, curvature, shape, material, thickness, hardness, and other properties that have an effect on the spring constant of each side. In addition, in the embodiment shown in FIGS. 4A-C, the directions of the force vectors $F_{A1}$ and $F_{C1}$ at the first and second positions, respectively, are substantially opposite from each other. Substantially opposite as used in the context of the directions of the force vectors at the first and second positions may include being within 0 to 30 degrees of exactly opposite directions. For example, using the first position shown in FIG. 4A and the second position shown in FIG. 4C, force vectors $F_{A1}$ and $F_{C1}$ at assembly pivot point 440 in the respective positions are substantially opposite, where they are approximately 13 degrees off of being exactly opposite from each other.

Figure 6B:
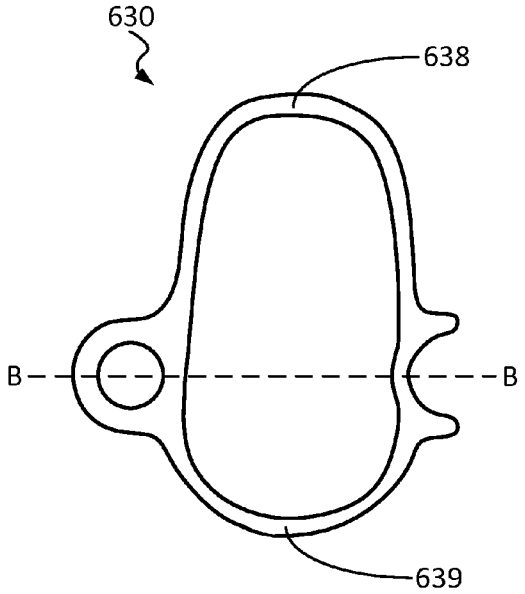

In some embodiments, assembly 200 may be configured such that it may take more or less force to switch from the first to the second position than it takes to switch from the second to the first position. For example, in such an embodiment, assembly 200 may use a detent spring with asymmetrical sides (e.g., where one side is longer, thicker, of different material or hardness, etc. than the other side). Such an example is shown in FIG. 6B, where side 638 of detent spring 630 is longer than side 639 (where the sides are split along dashed line B). Therefore, in an embodiment of a safety assembly including detent spring 630, it may take less force to switch to a position on the same side as detent spring side 638 (e.g., an upward position) than it would to switch to a position on the same side as detent spring side 639 (e.g., a downward position). In other words, if detent spring 630 were used in the assembly shown in FIG. 4B, the force vectors $F_{A2}$ and $F_{C2}$ at assembly pivot point 440 would have unequal magnitudes. In addition, detent spring 630 may be installed in one of two orientations in the assembly—with longer side 638 on the side of the first position or the second position—allowing the user to decide which toggling direction takes more/less force. For example, when detent spring 630 is installed in one orientation, more force may be needed to switch to a first/fire position (and therefore less force would be needed to switch to a second/safe position). Alternatively, when detent spring 630 is installed in the other orientation, more force may be needed to switch to a second/safe position (and therefore less force would be needed to switch to a first/fire position).

Figure 6C:
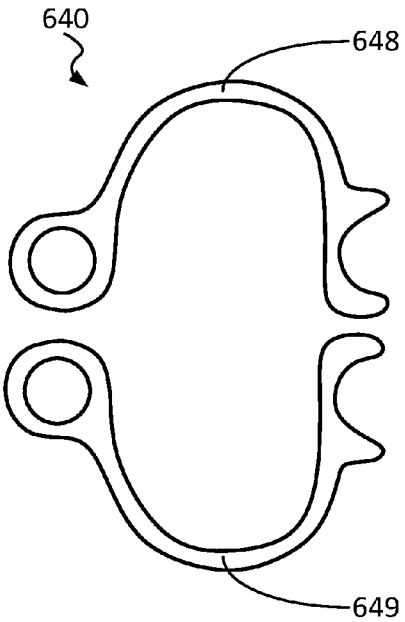

FIG. 6C shows an example detent spring 640 that may be used in a safety assembly configured in accordance with an embodiment of the present disclosure. As shown, detent spring 640 is made up of first portion 648 and second portion 649. The two spring portions 648 and 649 may be configured with different spring constants to achieve the same effect as described above with reference to FIG. 6B. In other words, in an embodiment of a safety assembly including detent spring 640 in a safety assembly, it may take less force to switch to a position on the same side as detent spring side 648 (e.g., an upward position) than it would to switch to a position on the same side as detent spring side 649 (e.g., a downward position), such as where the spring constant of first portion 648 is lower than the spring constant of second portion 649, for example. The two portion detent spring 640 shown in FIG. 6C also allows a user to switch the position of the portions 648 and 649, or switch out one of the portions with another spring portion to adjust the properties of the safety assembly, such as the forces needed to toggle the assembly or the positive feedback provided when toggling.

Figure 7A:
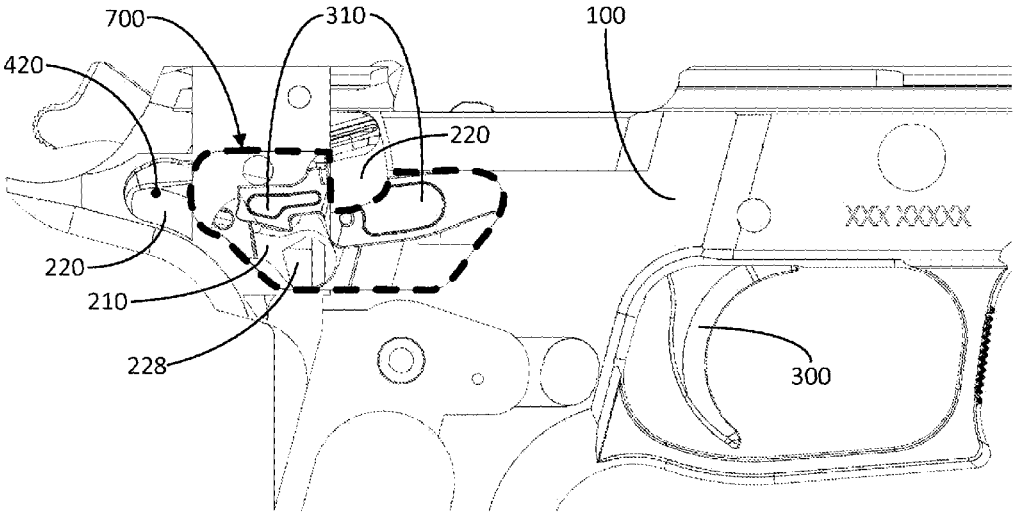
FIGS. 7A-B illustrate a safety assembly in fire and safe positions, respectively, in accordance with an embodiment of the present disclosure.
Figure 7B:
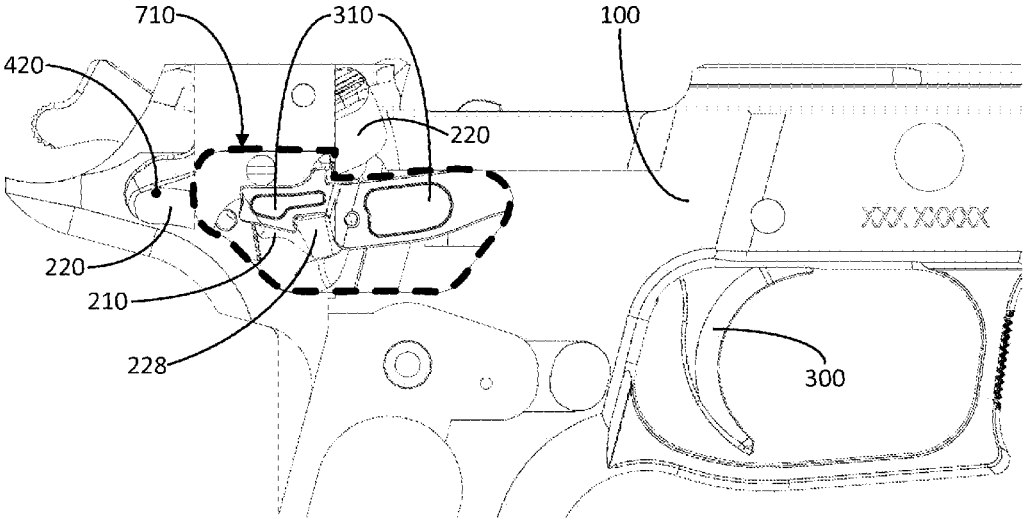

FIGS. 7A-B illustrate a safety assembly in fire and safe positions, respectively, in accordance with an embodiment of the present disclosure. As previously described, the safety assembly may be used to provide a safety mechanism in numerous ways. In one example, the safety assembly may be used to provide a mechanical block to one or more firing components of a firearm, such as its trigger bar, sear, trigger, slide, hammer, and/or another suitable component. In another example, the safety assembly may be used to disengage one or more firing components of a firearm, such as its trigger bar, sear, hammer, and/or another suitable component. In this embodiment, trigger 300 and trigger bar 310 are installed in frame 100 and can interact as previously described (with reference to FIGS. 1A-B). In addition, portions of the right side of the safety assembly have been cut out to provide a viewpoint into the frame (through frame aperture 142 depicted in FIG. 1B) to illustrate the interaction between the safety assembly and trigger bar 310 as depicted in the dashed areas 700 and 710.

As can be seen in FIG. 7A, the safety assembly in this embodiment is in a first/fire position (downward position) which allows the firearm (when fully assembled) to be fired. The firearm can be fired by pulling trigger 300 toward the rear of frame 100, causing trigger bar 310 to be moved toward the front of frame 100. For completeness of description, when trigger bar 310 is moved toward the front of frame 100, it may disengage a sear, causing a hammer to be released to strike a cartridge. As shown in area 700, blocking portion 228 on second lever 220 is not mechanically blocking trigger bar 310 (and neither is any other part of the safety assembly) while assembly is in the fire position. In this manner, trigger bar is unencumbered from moving forward in frame 100 when firing the firearm.

As can be seen in FIG. 7B, the safety assembly in this embodiment is in a second/safe position (upward position), which prevents the firearm (when fully assembled) from being fired. As shown in area 710, blocking portion 228 on second lever 220 is mechanically blocking trigger bar 310 such that trigger bar is prevented from moving forward in frame 100. Therefore, a user can not pull back on trigger 300 when the safety assembly is in the safe position shown in FIG. 7B (or the user may only pull back a minimal distance, but not enough to cause the firearm to fire), since blocking portion 228 is causing a mechanical block to trigger bar 310. In some embodiments, the safety assembly may only include first lever 210 and detent spring 230, as previously described. In such embodiments, first lever 210 may contain a blocking/disengaging portion (e.g., blocking portion 218 shown in FIG. 2A) used to block/disengage a firearm firing component (e.g., the trigger bar of the firearm).

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

What is claimed is:

1. A firearm safety assembly comprising:

a first lever pivotally coupled to a frame at a first frame pivot point; and a detent spring pivotally coupled to the frame at a second frame pivot point and in contact with the first lever at an assembly pivot point;

wherein the detent spring is under compression, the compression force in a direction substantially aligned with a major plane of the frame; and wherein the detent spring is configured to pivot about the assembly pivot point relative to the first lever.

2. The assembly of claim 1, wherein the compression force on the detent spring biases the assembly pivot point away from a straight line alignment with the first frame pivot point and the second frame pivot point.

3. The assembly of claim 1, wherein the first lever includes a protrusion configured to mechanically block and/or disengage a firing component of the firearm.

4. The assembly of claim 1 further comprising:

a second lever pivotally coupled to the frame at a third frame pivot point; and a link connecting the first and second levers.

5. The assembly of claim 4, wherein a main axis of the link aligns with the axis of rotation at the assembly pivot point.

6. The assembly of claim 1, wherein the detent spring includes an aperture configured to align with a boss on the frame.

7. The assembly of claim 1, wherein the detent spring is inserted into a recess in the frame and thereby does not increase the maximum width of the frame.

8. The assembly of claim 1, wherein the detent spring is symmetrical along at least one axis of the detent spring.

9. The assembly of claim 1, wherein the detent spring is asymmetrical along all axes of the detent spring.

10. The assembly of claim 1, wherein the detent spring is stamped from a single sheet of metal.

11. A two-position lever detent assembly comprising:

a first lever pivotally coupled to a firearm frame at a first frame pivot point; and a detent spring pivotally coupled to the frame at a second frame pivot point and in rotational contact with the first lever at an assembly pivot point;

wherein in a first assembly position, the force vector at the assembly pivot point is in a first direction; and wherein in a second assembly position, the force vector at the assembly pivot point is in a second direction, the second direction within 30 degrees of 180 degrees from the first direction.

12. The assembly of claim 11, wherein the first assembly position is a firearm fire position and the second assembly position is a firearm safe position.

13. The assembly of claim 11, wherein the detent spring includes a yoke, the yoke in rotational contact with the first lever at the assembly pivot point.

14. The assembly of claim 11, wherein the magnitude of the force vector at the assembly pivot point in the first assembly position is greater than the magnitude of the force vector at the assembly pivot point in the second assembly position.

15. The assembly of claim 11, wherein in a third assembly position, the assembly pivot point includes two force vectors that are substantially opposite in direction.

16. The assembly of claim 15, wherein the magnitudes of the force vectors at the third assembly position are equal.

17. The assembly of claim 15, wherein the magnitudes of the force vectors at the third assembly position are not equal.

18. The assembly of claim 11, wherein positive feedback is provided by the assembly when switching between the first and second assembly positions.

19. A firearm safety assembly comprising:

a first lever pivotally coupled to a frame at a first frame pivot point;

a second lever pivotally coupled to the frame at a second frame pivot point;

a link connecting the first and second levers; and a detent spring pivotally coupled to the frame at a third frame pivot point and in contact with the link, wherein the detent spring is configured to pivot about the link.

20. The assembly of claim 19, wherein the detent spring is under compression, the compression force in a direction substantially aligned with a major plane of the frame.

* * * * *